US011241047B1

(12) United States Patent
Hurst et al.

(10) Patent No.: US 11,241,047 B1
(45) Date of Patent: Feb. 8, 2022

(54) LOCKING ZIPPER AND GARMENTS ASSOCIATED THEREWITH

(71) Applicants: Caitlin Hurst, Lafayette, CO (US); John Huck

(72) Inventors: Caitlin Hurst, Lafayette, CO (US); Christa Huck, Elizabeth, CO (US); Richard Woodard, Charlotte, NC (US); Emily Caldwell, Charlotte, NC (US); Jess Lawrence, Charlotte, NC (US)

( * ) Notice: Subject to any disclaimer, the term of this patent is extended or adjusted under 35 U.S.C. 154(b) by 0 days.

(21) Appl. No.: 17/190,679

(22) Filed: Mar. 3, 2021

(51) Int. Cl.
*A44B 19/26* (2006.01)
*A44B 19/30* (2006.01)
*A41B 13/00* (2006.01)

(52) U.S. Cl.
CPC ..... *A41B 13/005* (2013.01); *A44B 19/262* (2013.01); *A44B 19/301* (2013.01)

(58) Field of Classification Search
CPC ... A44B 19/301; A44B 19/262; A44B 19/306; A44B 19/308; Y10T 24/2571; Y10T 24/2573
See application file for complete search history.

(56) References Cited

U.S. PATENT DOCUMENTS 2,019,219 A * 10/1935 Gammons ..... A44B 19/306 24/420
2,303,750 A * 12/1942 Marinsky ..... A44B 19/305 24/418
3,068,542 A * 12/1962 Firing ..... A44B 19/306 24/421
3,579,749 A * 5/1971 Holman ..... A44B 19/305 24/421
4,102,022 A * 7/1978 Aoki ..... A44B 19/308 24/424
4,391,022 A * 7/1983 Oda ..... A44B 19/306 24/421
4,422,220 A * 12/1983 Oda ..... A44B 19/306 24/421
5,152,036 A * 10/1992 Oda ..... A44B 19/308 24/424
5,528,802 A * 6/1996 Akashi ..... A44B 19/303 24/418
5,806,151 A * 9/1998 Uchiyama ..... A44B 19/303 24/418
2002/0152591 A1* 10/2002 Nagata ..... A44B 19/306 24/421
2007/0163092 A1* 7/2007 Lin ..... A44B 19/262 24/415
2009/0064468 A1* 3/2009 Iwase ..... A44B 19/305 24/419
2012/0260469 A1* 10/2012 Yamamoto ..... A44B 19/306 24/419

* cited by examiner

*Primary Examiner* — Robert Sandy
*Assistant Examiner* — Rowland Do
(74) *Attorney, Agent, or Firm* — Leyendecker & Lemire

(57) ABSTRACT

A locking zipper pull is described wherein the zipper pull is locked when the pull's lever(s) are locked in a first position and can be unlocked by moving the lever(s) into a second position to allow the zipper pull to be slid along an associated zipper chain.

16 Claims, 8 Drawing Sheets

LOCKING ZIPPER AND GARMENTS ASSOCIATED THEREWITH

BACKGROUND

Older infants and younger toddlers who have yet to be potty trained often are put to bed or down for a nap in footie pajamas or similar onesie-type garments that are closed by way of zippers. The zipper can be on the front, side or back of the garment. Some children, showing both desire and dexterity, remove the garment by unzipping it. After removing the pajamas these children often also remove all remaining clothing including their diapers. A naked child no longer properly attired can become cold and possibly suffer deleterious consequences, such as becoming sick. Perhaps equally disturbing, the unclothed child may one or both pee and defecate in it crib cause a unsanitary mess, which may also result in illness.

To prevent the unwanted unzipping and removal of these garments by a child, caregivers may resort to covering the zipper pull with tape to prevent access. However, determined infants may find a way to remove the tape and access the zipper pull. Further, tape with sufficient adhesiveness to securely attach to the garments fabric can then stick to the baby's skin and/or hair causing irritation or other issues.

Other caregivers have taken to using a safety pin to attach the pull to an adjacent portion of the garment's fabric preventing a child from unzipping the zipper. Unfortunately, some children have been able to undo the pin and consequently run a risk of getting stabbed by the exposed point.

DETAILED DESCRIPTION

Figure 1:
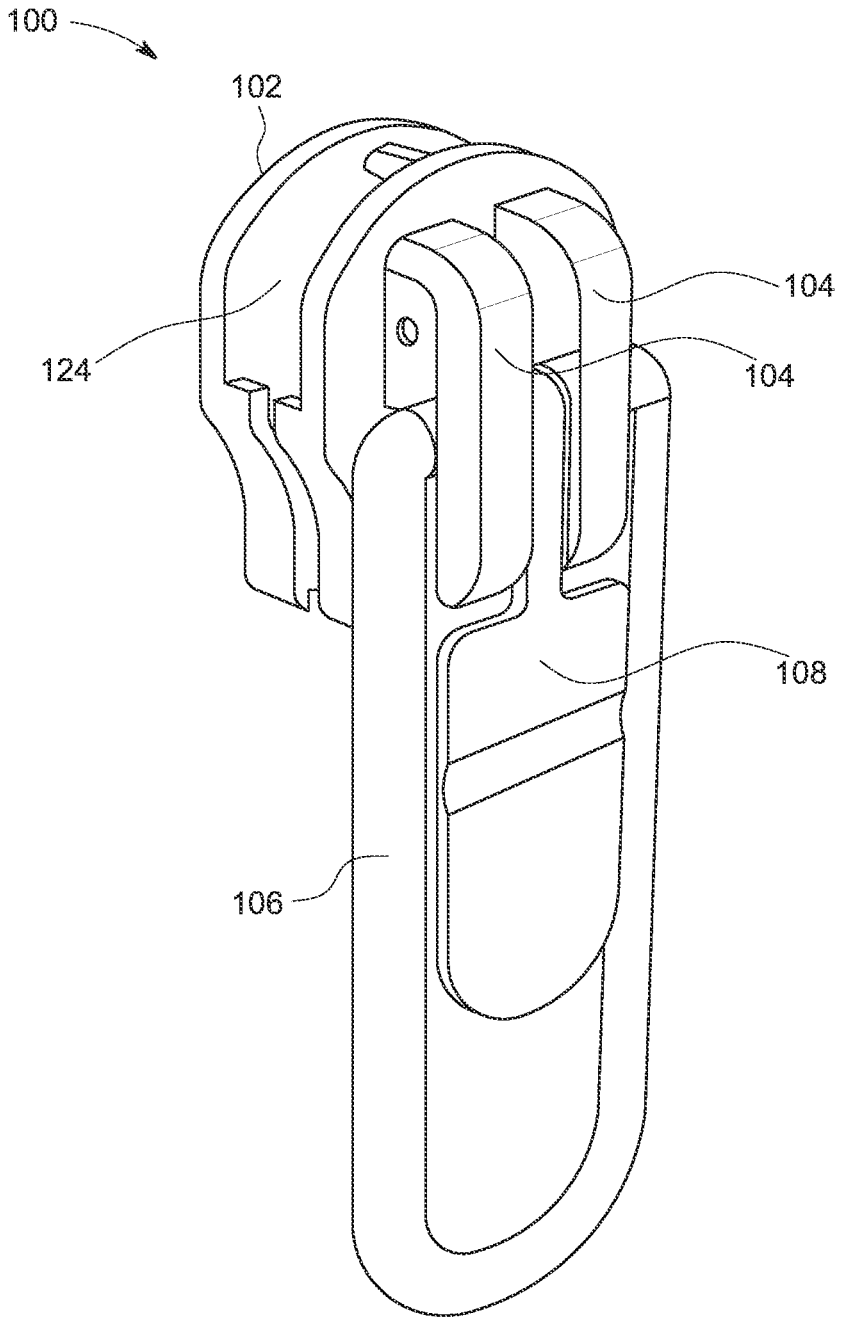
FIGS. 1 & 2 are perspective front and back of a locking zipper pull assembly according to an embodiment of the present invention.
Figure 2:
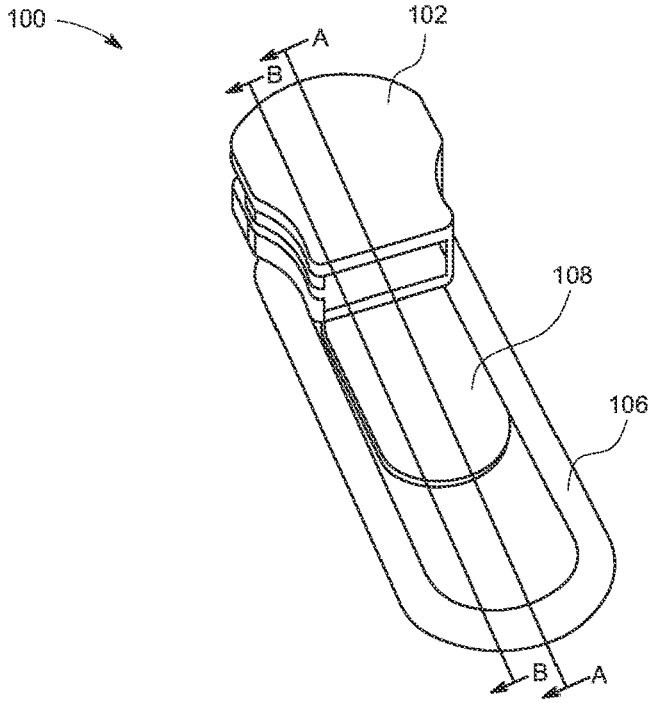
Figure 3:
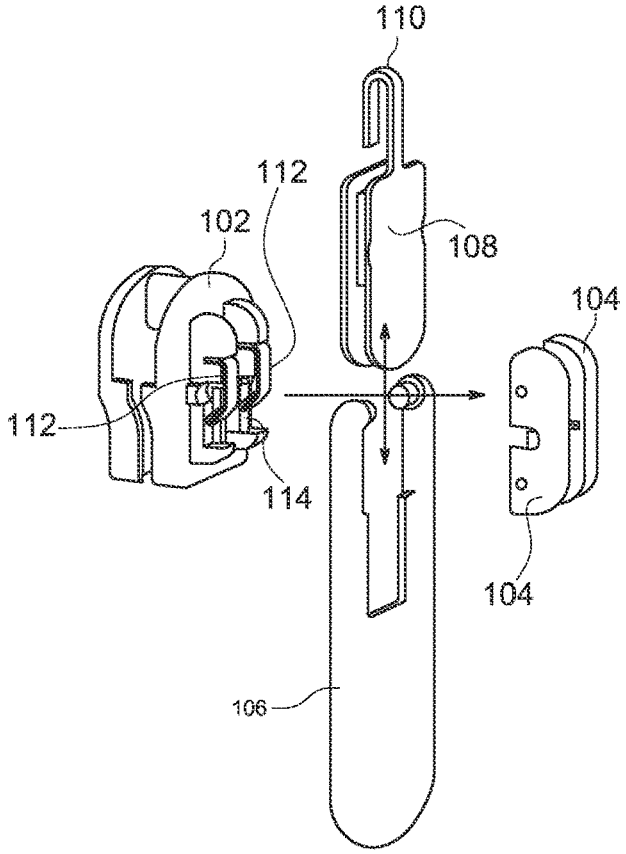
FIG. 3 is an exploded view of the locking zipper pull assembly according to the embodiment of the present invention.

Embodiments of the present invention comprise a locking zipper pull to be used on a zipper chain to open and close the chain with the chain typically being sewn or otherwise associated with a garment or other article that includes portions that can be opened and closed. When the primary and actuator levers of the zipper pull assembly are in a first position, typically parallel to the zipper chain, the zipper pull assembly is in a locked configuration wherein the levers cannot be slid along the chain to open or close it. Additionally, when the primary lever is held in a second position, typically perpendicular to the zipper chain, and the actuator lever is slid outwardly, the zipper pull assembly can be slid along the chain to open or close it.

When this embodiment is used on a zipper chain associated with an infant's garment, the infant is unlikely to be able to manipulate the zipper pull assembly such that he/she can unzip the chain and free himself/herself from the garment. Infants and young toddlers don't have the dexterity to hold the levers in the correct position while also pulling the zipper pull assembly along the chain.

In at least one embodiment the locking mechanism contained within the zipper pull assembly comprises a pin bracket wherein a pin or tongue of the bracket is normally biased towards the zipper chain. The tongue extends between adjacent upper and lower chain elements preventing a user from sliding the zipper pull assembly either upwardly or downwardly unless the associated levers are held in specific positions. The levers includes an actuator lever that is nested against or contained along a primary lever with both levers pivotally attached to the housing. The actuator lever, which can comprise part of the locking mechanism, further includes a release hook that is configured to interface with the pin bracket, such that when the both levers are moved into a perpendicular second position, a user can slide the actuator lever outwardly along the primary lever causing the release hook to pull the pin bracket's tongue out from between the chain elements whereby the zipper pull assembly can be slid along the chain.

Terminology

The terms and phrases as indicated in quotation marks ("") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment ", "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20 % of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

The terms "tongue" and "pin" refer interchangeably to the element that is moved away from the zipper chain to permit slidable movement of the zipper pull assembly.

An Embodiment of a Locking Zipper

Figure 12:
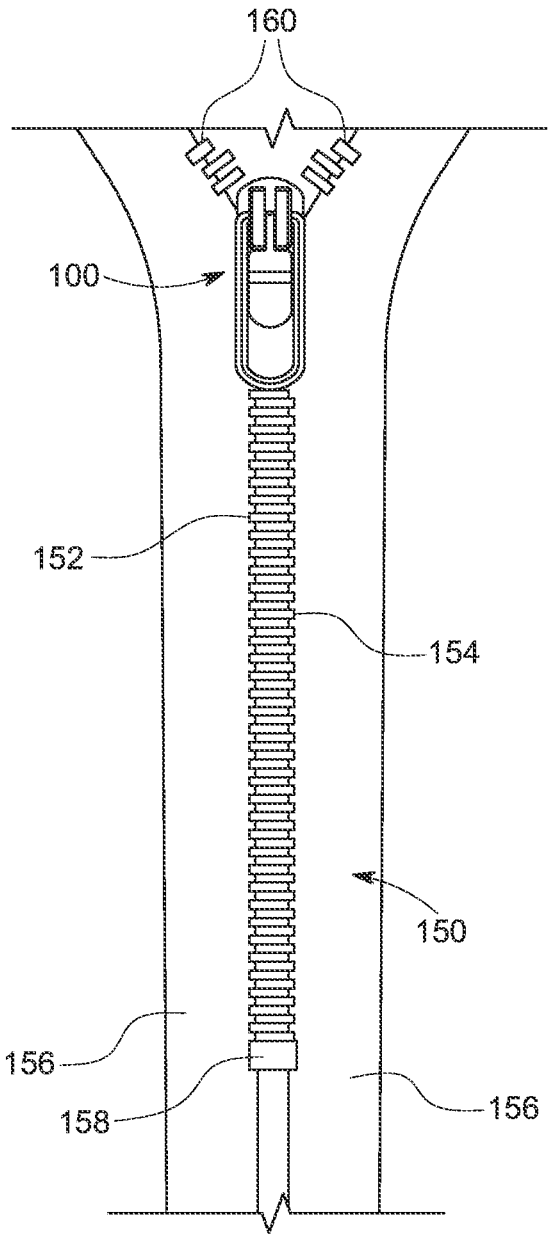
FIG. 12 is an illustration of a zipper assembly including a zipper chain and the locking zipper pull assembly operatively coupled to the zipper chain according to an embodiment of the present invention.
Figure 13:
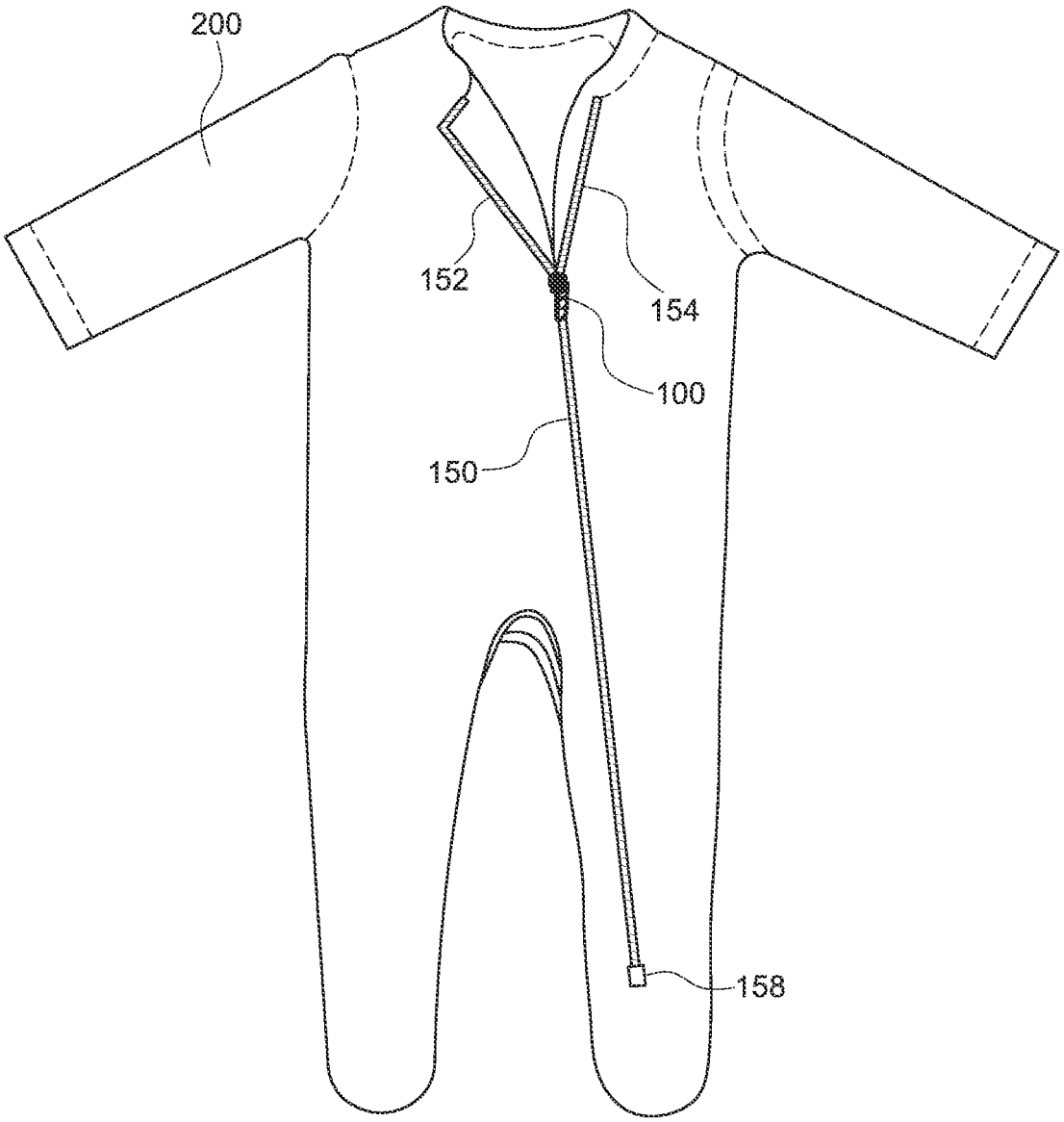
FIG. 13 is an illustration of infant pajamas utilizing the locking zipper pull assembly according to an embodiment of the present invention.

FIGS. 1-11 illustrate an embodiment of a locking zipper pull assembly and various components and subassemblies thereof. FIG. 12 illustrates the zipper pull assembly incorporated into a zipper assembly including a zipper chain. Finally, FIG. 13 illustrates the locking sipper pull assembly incorporated with the zipper chain into infant pajamas.

With reference to FIGS. 1-3 & 12, the locking zipper pull assembly comprises (i) a primary lever 106, (ii) an actuator lever 108, and (iii) a housing assembly that includes the housing itself 102 into which left and right chain channels 124 are formed wherein the respective opposing left and right lengths 152 & 154 of the zipper chain 150 can be received. The housing assembly further includes a pair of housing caps 104 that are snapped onto and crimped to the housing and secure the levers and other components of the locking mechanism 112& 114 to the zipper pull assembly.

The primary lever 106 is pivotally secured to the housing assembly and is configured to pivot about 180 degrees relative to the housing. Normally, the primary lever, which acts as a means to pull the zipper housing along the zipper chain hangs downwardly in a resting (or first) position.

The actuator lever 108 is received over the primary lever 106 be way of chain channels formed therein that are received over inwardly facing flanges formed in the primary lever so that the actuator lever is parallel to the primary lever and can slide back and forth along the primary lever. The actuator lever includes a U-shaped hooked end 110 that extends into the housing assembly, passes through a slot 117 in a pin bracket 114 of the locking mechanism wrapping around the pin bracket. The interaction and operation of the pin bracket and actuator lever are described in detail below.

Figure 4:
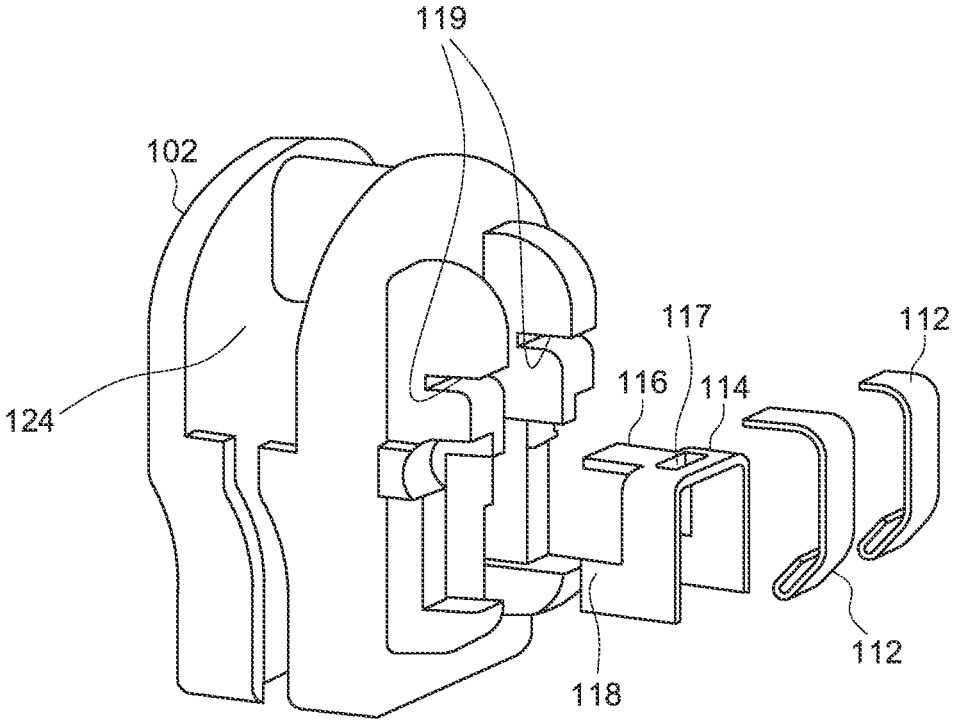
FIG. 4 is an exploded view of a zipper pull housing and components of the locking mechanism according to the embodiment of the present invention.
Figure 5:
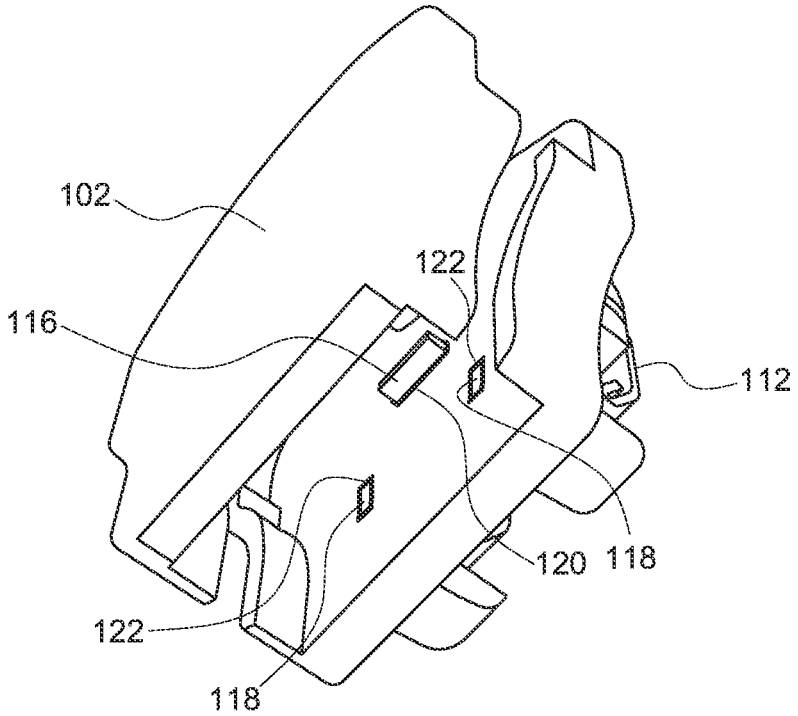
FIGS. 5&6 are front and bottom perspective views of the zipper pull housing and components of the locking mechanism according to an embodiment of the present invention.
Figure 6:
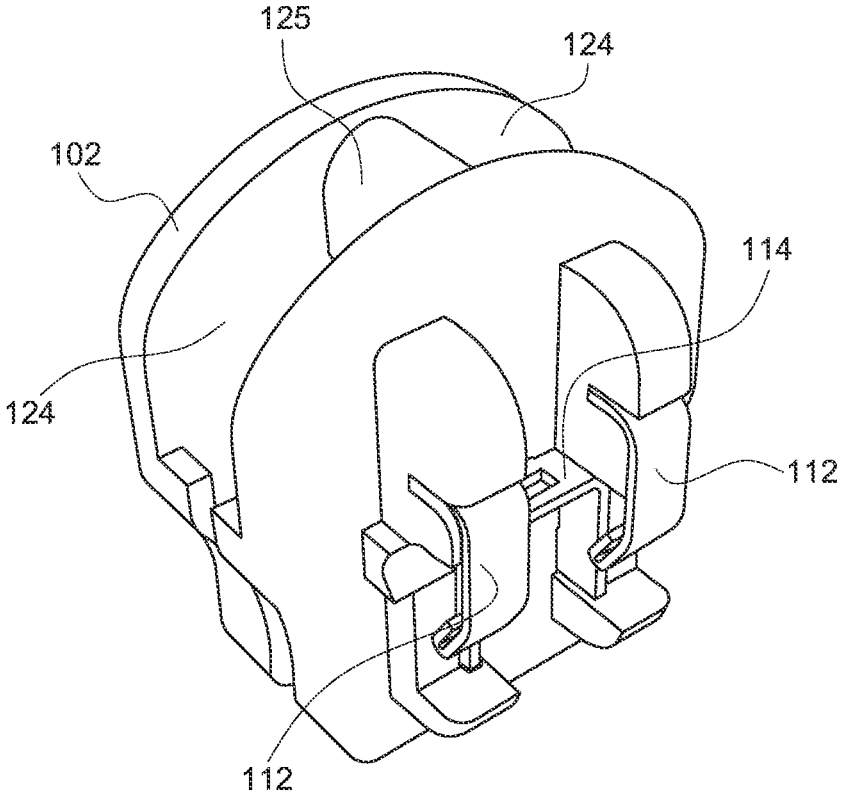

Components of a locking mechanism comprising a pin bracket 114 and a pair of formed plate spring members 112 are substantially contained within the housing assembly as best shown in FIGS. 5 & 6. FIG. 4 shows an exploded view of the springs and the pin bracket.

The pin bracket 114 typically comprises a plate that has been formed into an inverted U-shape having a middle shoulder portion with left and right arms extending downwardly therefrom. The shoulder portion includes a horizontally orientated pin 116 or tongue that extends rearwardly and outwardly therefrom. Each leg includes a vertically-orientated rearwardly-extending plate extension 118 near the distal end thereof. Each plate extension extends a shorter distance rearwardly than the pin for reasons that will become apparent below.

The plate spring members 112 are generally formed into a C-shape with a top leg of the C being configured to be received into a spring slot 119 in the housing 102 to hold it in place. The bottom leg of the C extends outwardly from the bottom of the vertical body portion at an acute angle with the end of the bottom leg configured to rest against the front side of an arm of the pin bracket 114 and flex when the spring is activated.

As assembled, the pin bracket is received into the housing 102 with the horizontal pin 116 extending through a pin slot 120 in the body and into the zipper chain channel 124 of the housing as shown in FIG. 5. The plate extensions 118 are each received into plate extension slots 122 in the housing, but being shorter, they do not extend into the zipper chain channel 124 in such a manner as would interfere with the normal operation of the zipper pull assembly in contrast to the horizonal pin.

Each plate spring member is received into a spring slot 119 of the housing with the bottom leg thereof resting against the front side of the pin bracket as best shown in FIG. 6 biasing the pin bracket against the housing and pushing the horizontal pin fully into the zipper chain channel 124. The plate extensions 118 are also pushed fully into their respective slots 122. The primary and actuator levers 106 & 108 are received into the housing assembly by threading the U-shaped hook 110 through the slot 117 on the shoulder of the pin bracket and placing the proximal pivotal cylindrical ends of the primary lever 107 against the respective faces of the plate spring's body. To secure the assembly together, the housing caps 104 are slid into place over the plate springs and the corresponding protrusions on the housing, and crimped and/or snapped in place.

The various components of the locking zipper pull assembly 100 can be comprised of numerous different materials as are appropriate for the use and the loads experienced by the various components. Typically, however, the various components are comprised of metal. The plate springs 112 and the pin bracket 114 are typically stamped and then formed from plate steel; whereas, the housing 102, housing caps 104 and the levers 106 and 108 can be forged or cast out of an appropriate metal such as, but not limited to, aluminum, brass and zinc alloys.

As can be appreciated, the zipper pull assembly 100 is used in combination with a zipper chain 150 as is shown in FIG. 12. The zipper chain comprises left and right lengths 152 & 154 that each comprise a plurality of zipper elements all aligned with each other and attached to a fabric or plastic tape 156. The lengths are joined together at one end thereof by a bottom stop 158. At a top end, top stops 160 are typically provided that act to prevent the zipper pull assembly from being inadvertently and unintentionally slid off the top of the chain. Each length of the chain is received in corresponding sides of the zipper chain channel 124 of the housing 102. At the top of the housing, a channel bridge 125 is provided separating the right length from the left length.

When closing the zipper chain by sliding an unlocked zipper pull assembly 100 upwardly, the corresponding chain elements from the opposing lengths 152 & 154 are pushed into each other in a manner in which they interlock. Conversely, when undoing a zipper by sliding the unlocked pull downwardly, the interlocked chain elements impact the channel bridge 125 and are wedged apart. Unlike a prior art zipper, embodiments using the locking zipper pull assembly, effectively prevent a user from moving it either upwardly or downwardly unless the primary and actuator levers are held in the appropriate position to unlock the zipper pull assembly.

Figure 7:
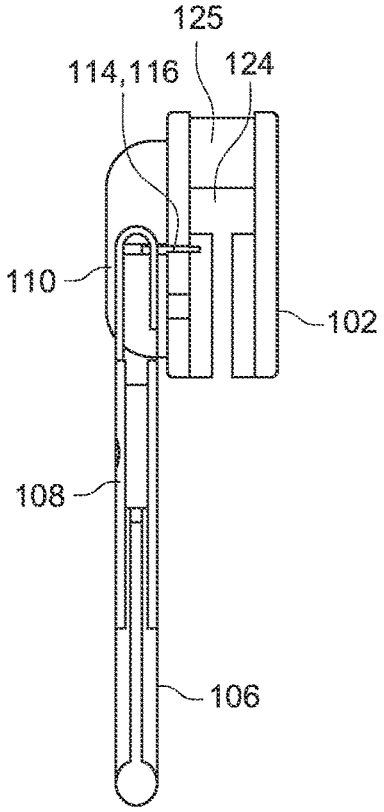
FIGS. 7-9 illustrate a cross sections of the locking zipper pull assembly with the levers in different positions effecting the operation of the locking mechanism according to an embodiment of the present invention.
Figure 8:
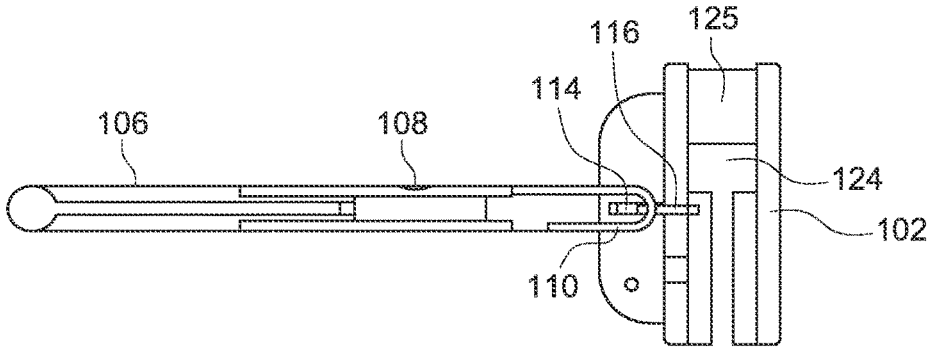
Figure 9:
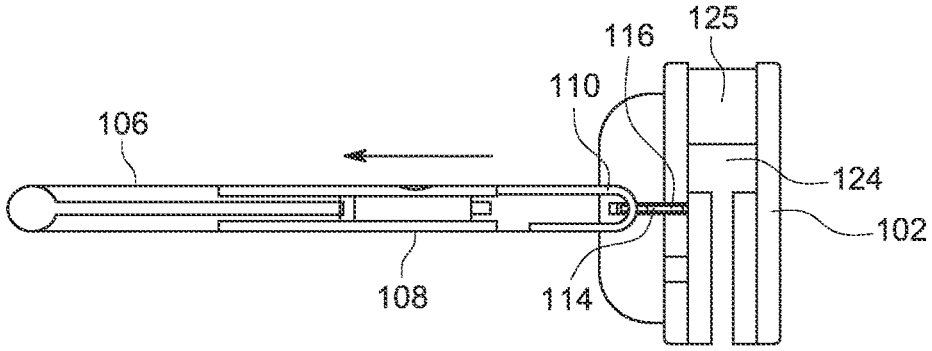
Figure 10:
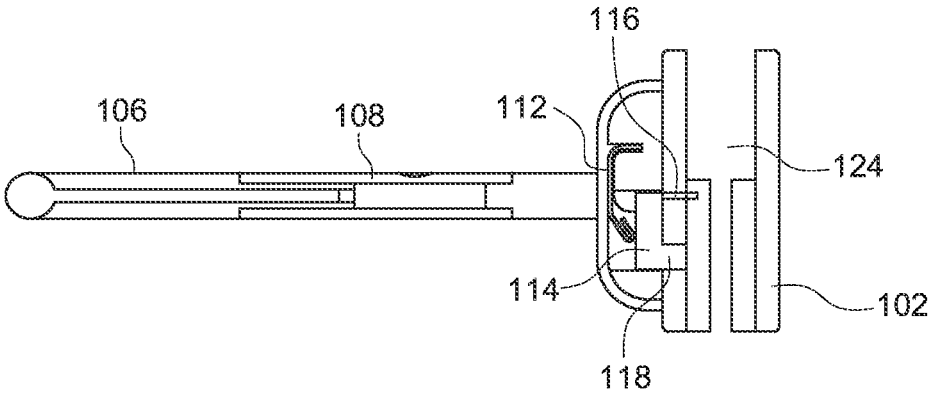
FIGS. 10 & 11 illustrate additional cross sections of the locking zipper pull assembly with the levers in a perpendicular position relative to the housing indicating the effect of sliding an actuator lever on the operation of the locking mechanism according to an embodiment of the present invention.
Figure 11:
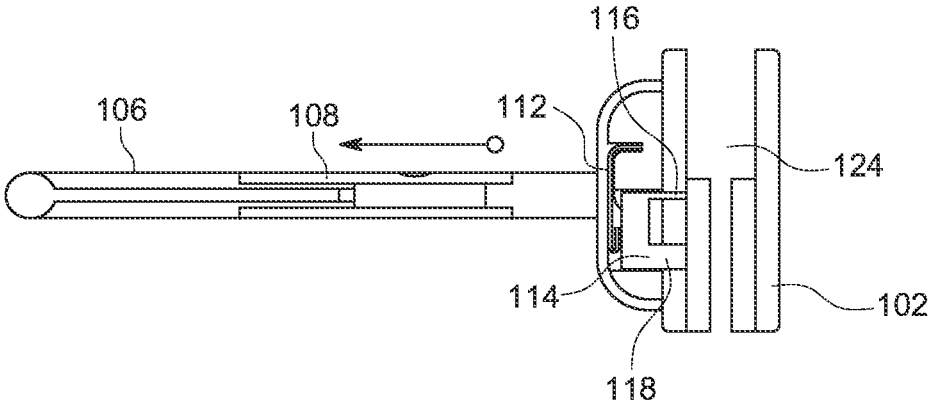

Operation of the locking mechanism is best described with reference to FIGS. 7-11 wherein FIGS. 7-9 show a cross section of the locking zipper pull assembly along line A-A of FIG. 1 and FIGS. 10&11 show a cross section of the locking zipper pull assembly along line B-B of FIG. 1.

With reference to FIG. 7, when the levers 106 & 108 are in a resting (or first) position such as hanging downwardly (although the same condition exists when rotated upwardly as well), the horizontal pin 116 of the pin bracket 114 extends inwardly into the chain channel 124 biased therein by the plate springs 112. The pin impacts and is inserted at least partially between the elements of the zipper chain 150 preventing a user from sliding the chain in either direction. As can be seen in FIG. 7, the actuator lever 108 cannot be slid outwardly along the primary lever being prevented from doing so by the pin bracket 114 into which the u-shaped hook 110 of the actuator lever is received. Furthermore, in this position, the actuator lever is unable to counteract the biasing of the plate springs and pull the horizontal pin 116 of the pin bracket from the chain channel 124 to unlock the zipper pull assembly. See FIG. 10 to see the position of the plate springs relative to the pin bracket before the actuator lever is pulled outwardly.

Unlocking the zipper pull assembly typically requires two operations: first, the primary lever and associated actuator lever are moved in the second position wherein the length of the levers 106 & 108 are generally perpendicular to the housing 102, as well as the direction of travel of the housing along the zipper chain when zipping and unzipping; and second, the actuator lever 108 is pulled outwardly away from the housing along the primary lever 106 to also pull the horizontal pin 116 from the zipper chain channel 124. The first operation is illustrated in FIGS. 8 & 10. The second operation is illustrated in FIGS. 9 & 11.

By moving the levers 106 & 108 into the perpendicular position, the direction in which the actuator lever can be moved relative to the primary lever becomes aligned with the only direction the pin bracket 114, which is connected to the actuator lever by the lever's U-hook extension 110, can move in the housing 102 as dictated by the pin slot 120 and the plate extension slots 122. As clearly shown in FIG. 10 for the illustrated embodiment, just moving the levers into the perpendicular position alone does not permit slidable movement of the zipper pull assembly 100 along the zipper chain 150 as the plate springs 112 continue to bias the horizontal pin 116 through the pin bracket into the chain channel 124 and consequently against the zipper chain.

By sliding the actuator lever 108 outwardly along the primary lever 106 when in the perpendicular position, the U-hook 110 pulls the pin bracket 114 outwardly compressing the plate springs 112 and consequently pulling the horizontal pin 116 from the chain channel 124 freeing the housing 102 and the zipper pull assembly 100 for upwardly and downwardly movement along the chain 150. In this embodiment, however, movement can only be accomplished so long as the actuator lever is held in its outward position relative to the primary lever as releasing the actuator lever will cause the plate springs to move and bias the pin bracket and horizontal pin back into the pin channel 120 and against the zipper chain.

As can be appreciated there are many variations to the zipper pull assembly and its various components. For instance, the shape and configuration of the pin bracket and the horizontal pin (or tongue) can be substantially different from what is shown in the illustrated embodiment while still performing the same function. Similarly, the shape and configuration of the biasing spring can differ from the plate springs as shown. In some variations, only one spring may be used, and in yet another variation, the biasing spring can be integrated into the pin bracket itself.

The configuration and interaction of the levers can also vary. As shown the actuator lever 108 is captively retained along the primary lever 104, but in variations it can be physically separate from the primary lever and just held against and substantially parallel the primary lever during operation. In yet other variations, an actuator tab contained on or in the primary lever may be substituted for a lever. The actuator lever extension shown as a U-hook 110 herein can vary as well as can its manner of attachment and interaction with the pin bracket.

In one possible variation an extension may be a part of the primary lever itself wherein a separate actuator lever or mechanism is not required. In such a variation, there can be a cam member on the primary lever that pulls the pin bracket outwardly as the primary lever is moved into the perpendicular position, such that zipping and unzipping can be accomplished whenever the lever is held perpendicular to the direction of zipper pull travel.

The illustrated embodiment describes the second position (or unlocking position) as being orthogonal to the housing and the direction of zipper pull travel during zipping and unzipping. The unlocking, or second, position can vary in other embodiments and need not necessarily be perpendicular to the direction of zipper pull travel.

An Embodiment of a Garment Using a Locking Zipper

FIG. 13 illustrates the locking zipper pull assembly in combination with a zipper chain of an infant one piece pajama 200. Of note, is that the zipper on this pajama incorporates the locking zipper pull assembly 100 making it difficult for infants to manipulate the zipper and undress themselves as they just do not have the motor skills to finely position the primary lever 106 into proper position while also pulling the primary lever as they unzip the pajama. The further requirement that the actuator lever 108 be pulled and held outwardly makes manipulation of the zipper even more difficult for an infant. In contrast, an adult can relatively easily manipulate the locking zipper pull to open and close it.

The locking zipper pull 100 can be used with any type of clothing wherein it is desirable to have additional security that the zipper will not unintentionally unzip. For instance, in one embodiment a locking zipper pull is used on a zippered pocket or a jacket, coat or other garment ensuring the contents of the pocket will not inadvertently fall out because the zipper slid open.

Other embodiments comprise articles other than clothing that utilize the locking zipper pull, such as but not limited to, luggage, purses, computer cases, and backpacks wherein the locked zipper pull hinders a would-be thief from stealthily, easily, and quickly unzipping and removing contents therefrom while the article is being held or carried by the user.

A Method of Using a Garment with a Locking Zipper

To use a one piece infant pajama 200 incorporating the locking zipper pull 100, an older caregiver first fully unzips the pajama by pulling the zipper pull in the unzipping direction along the chain 150 while simultaneously holding the levers 106 & 108 in the second position perpendicular to the direction of the zipper chain, and holding the actuator lever 108 pulled outwardly to release the horizontal pin of the pin bracket from the zipper chain.

Once fully unzipped the infant can be placed into the garment 200. Next, holding the levers 106 & 108 as described above, zipping the zipper until the zipper pull 100 is fully closed or closed to a desired position. Releasing the levers will cause the zipper pull to lock. Thereafter, the infant is snuggly received in the pajama and the caregiver can rest more easily that it is very unlikely that the child will be able to extricate himself or herself from the garment.

Other Variations and Embodiments

The various embodiments and variations thereof described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

We claim:

1. A zipper pull assembly for use in opening and closing a zipper chain, the zipper pull assembly comprising:

a housing assembly, the housing assembly being configured to receiving opposing left and right lengths of the zipper chain;

a primary lever pivotally attached to the housing assembly, the lever being pivotable between at least a first and second position; and a locking mechanism, the locking mechanism (i) immovably securing the housing assembly to the zipper chain when the primary lever is in at least a first position and (ii) releasing when the primary lever is in the second position permitting a user to move the housing along the zipper chain to open and close the opposing lengths, wherein the locking mechanism comprises (1) a protruding pin, the protruding pin being slidably received in a slot in the housing and configured to move between an extended position and a retracted position, (2) at least one biasing spring, the at least one biasing spring biasing the protruding pin in the extended position, and (3) an actuator lever, the actuator lever being nested with the primary lever and configured for slidable movement outwardly and inwardly along the primary lever, the actuator lever further including a release hook, the release hook extending into the housing assembly and being coupled to the pin bracket wherein moving the actuator lever outwardly only when in the second position causes the protruding pin to move into the retracted position.

2. The zipper pull assembly of claim 1 in combination with the zipper chain.

3. The combination of claim 2 in further combination with a garment, the zipper chain being secured to the garment.

4. The combination of claim 3 wherein the garment is an infant pajama.

5. A method of using the combination of claim 3, the method comprising:

moving the primary lever into the second position;

interlocking the zipper chain by sliding the housing over the zipper chain while the primary lever is in the second position; and moving the primary lever into the first position to lock the zipper pull assembly.

6. The combination of claim 2 wherein the lever is generally perpendicular to an adjacent portion of the zipper chain when in the second position.

7. The zipper pull assembly of claim 1, wherein the protruding pin is integral with a pin bracket.

8. The zipper pull assembly of claim 1 in combination with the zipper chain.

9. The combination of claim 8 in further combination with a garment, the zipper chain being secured to the garment.

10. The combination of claim 9, wherein the garment is an infant pajama.

11. A method of using the combination of claim 10, the method comprising:

putting the infant pajama on an infant;

moving the primary lever into the second position;

sliding the actuator lever outwardly while the primary lever is in the second position;

interlocking the zipper chain by sliding the housing over the zipper chain while the primary lever is in the second position and the actuator lever is slid outwardly;

releasing the actuator lever and moving the primary lever into the first position.

12. The combination of claim 8, wherein the lever is generally perpendicular to an adjacent portion of the zipper chain when in the second position.

13. The combination of claim 8, wherein (i) the left length of the zipper chain comprising a series of aligned left elements and the right length of the zipper chain comprising a series of aligned right elements, the right elements facing the left elements, the left and right elements being configured to interlock with each other, (ii) the protruding pin extending between adjacent upper and lower chain right chain elements and adjacent upper and lower chain left chain elements when in the extended position.

14. The combination of claim 13 in further combination with a garment, the zipper chain being secured to the garment.

15. The combination of claim 14, wherein the garment is an infant pajama.

16. A method of using the combination of claim 15, the method comprising:

putting the infant one piece on an infant;

moving the primary lever into the second position;

sliding actuator lever outwardly while the primary lever is in the second position;

interlocking the zipper chain by sliding the housing over the zipper chain while the primary lever is in the second position and the actuator lever is slid outwardly;

releasing the actuator lever and moving the primary lever into the first position.

* * * * *